US006684588B1

(12) United States Patent
Jones

(10) Patent No.: US 6,684,588 B1
(45) Date of Patent: Feb. 3, 2004

(54) BONDED SWIMMING POOL LADDER ANCHOR SOCKET

(76) Inventor: Jesse Jones, 1166 Key Pl., Vineland, NJ (US) 08360

( * ) Notice: Subject to any disclaimer, the term of this patent is extended or adjusted under 35 U.S.C. 154(b) by 0 days.

(21) Appl. No.: 10/151,767

(22) Filed: May 22, 2002

(51) Int. Cl.[7] ..... E02D 27/42

(52) U.S. Cl. ..... 52/298; 52/704; 52/296; 248/519; 182/108; 439/100

(58) Field of Search ..... 52/292, 296, 297, 52/298, 726.4, 736.1, 169.9, 169.8, 704; 182/93, 106–108; 248/530, 519, 346.01; 256/65.14; 439/100

(56) References Cited

U.S. PATENT DOCUMENTS

| | | | | | |
|---|---|---|---|---|---|
| 2,974,746 | A | * | 3/1961 | Baker | 182/93 |
| 3,065,820 | A | * | 11/1962 | Prizler et al. | 182/93 |
| 3,894,375 | A | * | 7/1975 | Lindberg, Jr. | 52/298 |
| 3,967,872 | A | * | 7/1976 | Mooney et al. | 439/100 |
| 3,990,671 | A | | 11/1976 | Seyler | |
| 4,008,550 | A | * | 2/1977 | Kaufman | 52/298 |
| 4,059,934 | A | * | 11/1977 | Hayamizu | 52/297 |
| 4,133,154 | A | * | 1/1979 | Ruzicka | 52/298 |
| 4,210,374 | A | * | 7/1980 | Churla | 439/100 |
| 4,716,987 | A | * | 1/1988 | Lindberg, Jr. | 182/97 |
| 4,829,732 | A | * | 5/1989 | Dahowski et al. | 52/298 |
| 4,962,285 | A | | 10/1990 | Baker | |
| 5,364,281 | A | | 11/1994 | Leto | |
| 5,460,532 | A | | 10/1995 | Leto | |
| 5,632,464 | A | * | 5/1997 | Aberle | 248/530 |
| 5,803,426 | A | * | 9/1998 | Hart | 248/523 |

FOREIGN PATENT DOCUMENTS

| | | | |
|---|---|---|---|
| DE | 2719081 | * | 11/1978 |

* cited by examiner

*Primary Examiner*—Winnie S. Yip
(74) *Attorney, Agent, or Firm*—Norman E. Lehrer

(57) ABSTRACT

A bonded swimming pool ladder anchor socket includes a substantially hollow metal housing of substantially cylindrical configuration. The housing is embedded in concrete adjacent the swimming pool with the top of the housing being open and adapted to receive the cylindrically shaped base of a swimming pool ladder for supporting the ladder. The bottom of the housing is at least partially closed to act as a stop to prevent downward movement of said ladder base beyond said bottom. An electrical bonding clamp is carried by the housing on the outer surface thereof and is adapted to securely clamp an electrical bonding conductor in order to provide an electrical bond for the housing and for the ladder. The bonding clamp includes a fixed seat for supporting the conductor and a movable screw threaded through the lower wall of a chamber located above the seat. The screw includes a head at the top thereof which is adapted to be turned by a screw driver in order to move the screw toward or away from the conductor. The head of the said screw is accessible through an aperture in the top wall of the chamber so that the screw can be moved to tighten the same even after the housing has been embedded in cement.

3 Claims, 2 Drawing Sheets

BONDED SWIMMING POOL LADDER ANCHOR SOCKET

BACKGROUND OF THE INVENTION

The present invention is directed toward a bonded swimming pool ladder anchor socket and more particularly, toward a bonded swimming pool ladder anchor socket which provides means for allowing the electrical bonding connection to be tightened even after the anchor has been embedded in concrete adjacent the side of the swimming pool.

Typically, swimming pool ladders and similar devices are supported by anchors that are embedded in the cement or concrete that surrounds the swimming pool. These anchors are generally made of metal and have open tops which allow the tubular base of a ladder to be inserted therein. A set screw, wedge or the like maintains the ladder base in the anchor.

Codes or regulations in many communities require that all metallic structural parts and fittings of a swimming pool such as metallic parts of the pool structure (including re-enforcing metal of the pool shell and deck), underwater lighting, metal fittings, electrical equipment, etc. be bonded or electrically interconnected in order to eliminate voltage gradients in the pool area. With respect to metal swimming pool ladders and the like, this is frequently accomplished by securing an electrical bonding connector to the anchor socket and to the pool bonding grid which also connects to the various other metallic structural parts and fittings. When the ladder base is inserted into the anchor and held therein, it too is then bonded. The anchors are typically bonded by clamping the electrical conductor thereto with a screw or the like. After the anchors are properly bonded, they are held in place and cement or concrete is poured around the anchors and the, bonding conductors to secure everything in place.

Because of changes in temperature and humidity and settling earth, it is not uncommon for the electrical bonding connections to the anchors to loosen. Unfortunately there is no way to conveniently tighten the bonding screw as it is frequently embedded in cement along with the rest of the anchor. The anchor is, therefore, either left ungrounded or the cement around the anchor must be broken up so that the anchor can be removed to tighten the bonding screw. The properly bonded anchor can then be replaced and again covered with cement until the problem reoccurs. Obviously this is undesirable as it is a time consuming procedure that may leave the pool deck in less than an acceptable aesthetic condition.

Thus, a need exists for a swimming pool ladder anchor socket that includes an electrical bond, and which provides means for allowing the electrical bonding connection to be tightened even after the anchor has been embedded in concrete adjacent the side of the swimming pool without having to, remove the anchor from the concrete.

SUMMARY OF THE INVENTION

The present invention is designed to overcome the deficiencies of the prior art discussed above. It is an object of the present invention to provide a swimming pool ladder anchor socket that includes an improved electrical bonding terminal thereon.

It is another object of the present invention to provide a bonded swimming pool ladder anchor socket that allows the bonding connection to be tightened from the top of the anchor.

It is a further object of the present invention to provide a bonded swimming pool ladder anchor socket that allows the bonding connection to be tightened even after the anchor is embedded in concrete adjacent the swimming pool.

In accordance with the illustrative embodiments demonstrating features and advantages of the present invention, there is provided a bonded swimming pool ladder anchor socket that includes a substantially hollow metal housing of substantially cylindrical configuration. The housing is embedded in concrete adjacent the swimming pool with the top of the housing being open and adapted to receive the cylindrically shaped base of a swimming pool ladder for supporting the ladder. The bottom of the housing is at least partially closed to act as a stop to prevent downward movement of said ladder base beyond said bottom. An electrical bonding clamp is carried by the housing on the outer surface thereof and is adapted to securely clamp an electrical bonding conductor in order to provide an electrical bond for the housing and for the ladder. The bonding clamp includes a fixed seat for supporting the conductor and a movable screw threaded through the lower wall of a chamber located above the seat. The screw includes a head at the top thereof which is adapted to be turned by a screw driver in order to move the screw toward or away from the conductor. The head of the said screw is accessible through an aperture in the top wall of the chamber so that the screw can be moved to tighten the same even after the housing has been embedded in cement.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
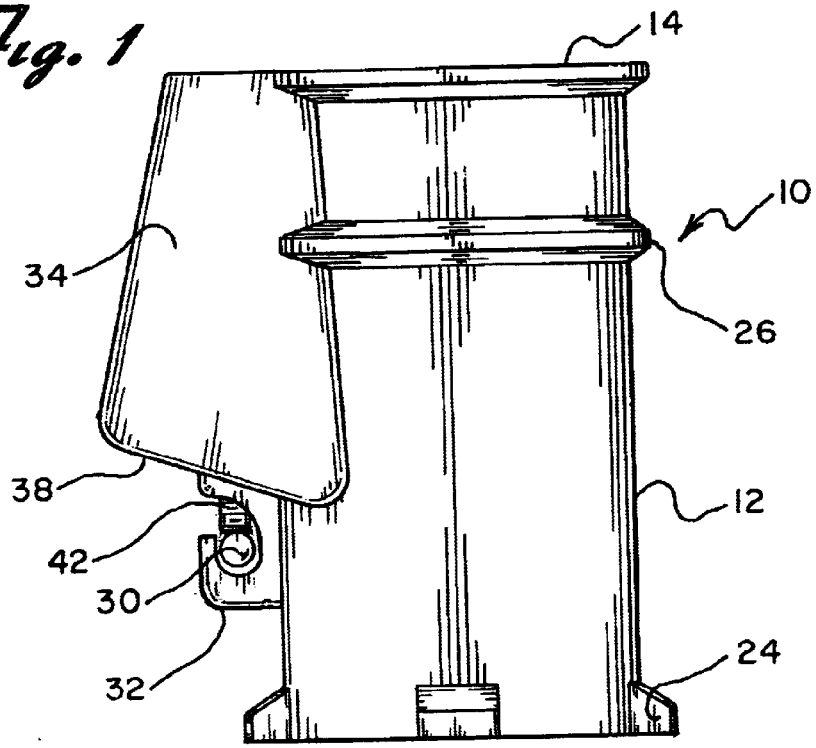
FIG. 1 is a side elevational view of a bonded swimming pool ladder anchor socket of the present invention.

Referring now to the drawings in detail wherein like reference numerals have been used throughout the various figures to designate like elements, there is shown in FIG. 1 a bonded swimming pool ladder anchor socket constructed in accordance with the principles of the present invention and designated generally as 10.

In the preferred embodiment, the anchor 10 essentially includes a generally cylindrically shaped tubular housing 12 having a top 14 and a bottom 16. The top is open as shown and is adapted to receive the cylindrically shaped base of a swimming pool ladder or the like into the interior 18 of the housing 12 in order to support the ladder base. The bottom 16, on the other hand, includes a wall portion 20 to at least partially close the bottom so as to prevent the downward movement of the ladder base beyond the bottom 16. A hole 22 is formed in the bottom wall 20 to allow water to drain.

As is well known in the art, anchor housings such as 12 are embedded in the cement or concrete that forms the skirt or pool deck or other area around a pool. The anchors 10 are set in place before pouring the cement and the cement hardens around the anchor in order to maintain the same in place. In this regard, the housing 12 includes a plurality of projections such as shown at 24 adjacent the bottom 16 and 26 in the upper portion thereof which help to firmly secure the anchor 10 in the cement.

Figure 2:
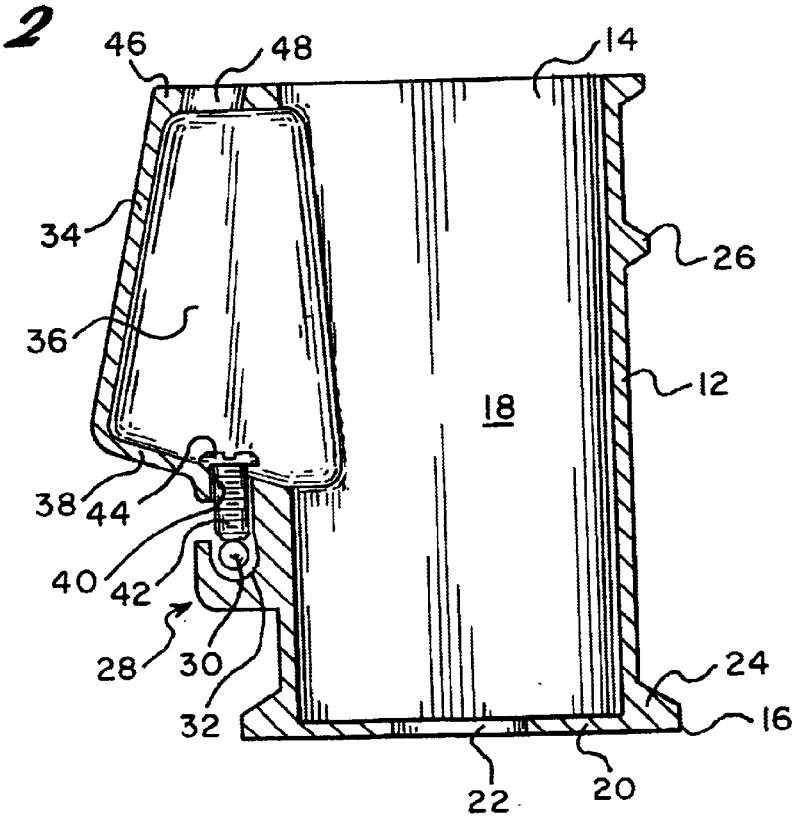
FIG. 2 is a cross-sectional view taken through line 2—2 of FIG. 1.
Figure 3:
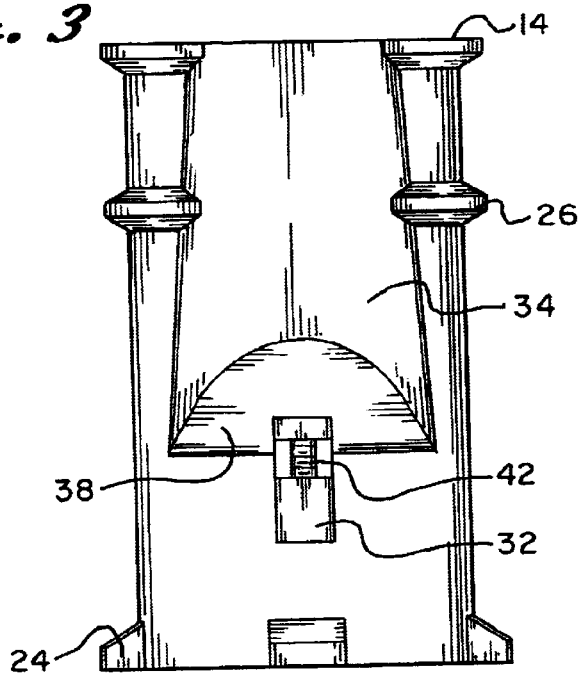
FIG. 3 is a front elevational view of the invention.
Figure 4:
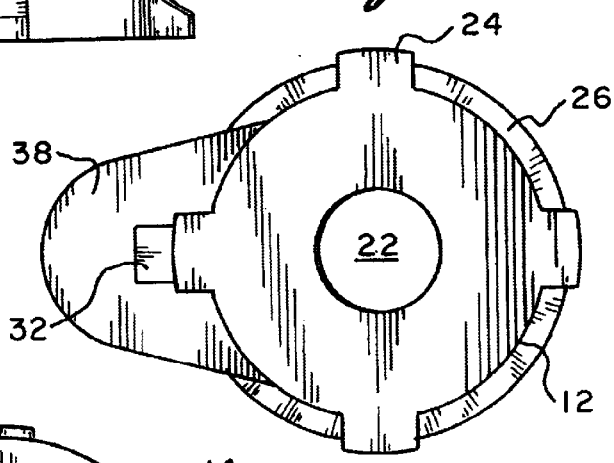
FIG. 4 is a bottom plan view thereof.

An electrical bonding clamp 28 is carried by the housing 12 and is located on the outer surface of the housing adjacent the lower portion thereof as shown best in FIGS. 1 and 2. The bonding clamp 28 is adapted to securely clamp an electrical bonding conductor 30 in order to provide an electrical bond for the housing 12 and for the ladder that is anchored in the housing. Although not shown, the ladder may be secured to the anchor 10 by a movable wedge located in the cavity 36 in a manner well known in the art and which wedge engages the ladder base. Since the entire anchor 10 is made of bronze, aluminum or other suitable metal, the metal ladder is thus bonded through the housing 12 and the bonding conductor 30.

The bonding clamp 28 is comprised of a fixed seat 32 as shown best in FIGS. 1 and 2 and faces upwardly. The seat 32 supports the conductor 30 therein. Located above the seat 32 is an outer chamber 34 that can either be attached to the outer surface of the housing 32 or can actually be formed as part of the housing 12 as the same is being machined. Thus, the inner cavity 36 of the chamber 34 can either be separate from the interior 18 of the housing 12 or be in full communication therewith.

In either case, the chamber 34 includes a bottom wall 38 having a threaded opening 40 therein. Screw 42 having a head 44 is threaded through the opening 40 and is adapted to engage the top of the bonding conductor 30. As should be readily apparent to those skilled in the art, when the screw 40 is rotated, it can be moved toward or away from the bonding conductor 30 in order to clamp the same tightly against the seat 32 or to loosen the same, if desired.

Figure 5:
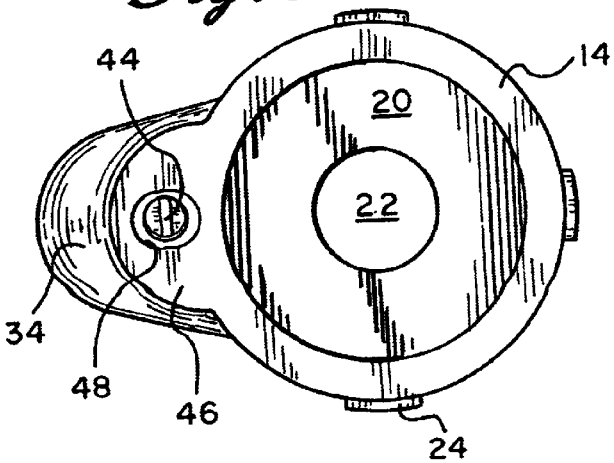
FIG. 5 is a top plan view thereof.

The chamber 34 also includes a partial top wall 46 which is substantially flush with the top 14 of the housing 12. An aperture 48 is formed in the top wall 46 to allow access to the head 44 of the screw 42. As shown best in FIGS. 2 and 5, the aperture 48 and the screw 44 are essentially in axial alignment with each other. Thus, by inserting a screwdriver through the aperture 48, the screw head 44 can be engaged so that the screw 42 can be turned. This allows the screw 42 to be turned to tightly clamp the bonding conductor 30 against the fixed seat 32 even if the entire outer circumference of the housing 12 is enclosed within cement or concrete.

The present invention may be embodied in other specific forms without departing from the spirit or essential attributes thereof and accordingly, reference should be made to the appended claims rather than to the foregoing specification as indicating the scope of the invention.

I claim:

1. A bonded swimming pool ladder anchor socket comprising:

a substantially hollow metal housing of substantially cylindrical configuration having a top and a bottom;

said top being open and being adapted to receive the cylindrically shaped base of a swimming pool ladder into the interior of said, housing in order to support the ladder base and said bottom being at least partially closed to act as a stop to prevent downward movement of said ladder base beyond said bottom;

an electrical bonding clamp carried by said housing and located on the outer surface of said housing, said electrical bonding clamp being adapted to securely clamp an electrical bonding conductor in order to provide an electrical bond for said housing and said ladder;

said bonding clamp being comprised of a fixed seat for supporting said conductor and a movable screw located above said seat, said screw having a bottom end adapted to engage said conductor and clamp the same against said fixed seat and a top end including a head adapted to be turned by a screw driver in order to move said screw toward or away from said conductor;

said screw head being accessible from above the top of said housing so that said screw head can be turned to move said screw even after said housing has been embedded in cement.

2. The bonded swimming pool ladder anchor socket as claimed in claim 1 wherein said housing includes an outer chamber adjacent the top thereof and being located on the outer surface of said housing, said chamber including a lower wall having having a threaded opening therein, said screw being threaded into said threaded opening.

3. The bonded swimming pool ladder anchor socket as claimed in claim 2 wherein said chamber includes a partial top wall having an aperture therein and wherein a screw driver is capable of passing through said aperture to engage said head of said screw.

* * * * *